US007753513B2

(12) United States Patent
Taira

(10) Patent No.: US 7,753,513 B2
(45) Date of Patent: Jul. 13, 2010

(54) INK-JET HEAD, FILTER ASSEMBLY USED FOR MANUFACTURING THE INK-JET HEAD, AND METHOD FOR MANUFACTURING THE INK-JET HEAD USING THE FILTER ASSEMBLY

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 966 days.

(21) Appl. No.: 11/300,321

(22) Filed: Dec. 15, 2005

(65) Prior Publication Data

US 2006/0092247 A1 May 4, 2006

Related U.S. Application Data

(62) Division of application No. 10/667,495, filed on Sep. 23, 2003, now Pat. No. 7,044,591.

(30) Foreign Application Priority Data

Sep. 25, 2002 (JP) ..... 2002-278766
Sep. 25, 2002 (JP) ..... 2002-279006
Sep. 25, 2002 (JP) ..... 2002-279108

(51) Int. Cl.
*B41J 2/175* (2006.01)
*B41J 2/05* (2006.01)
*B41J 2/17* (2006.01)

(52) U.S. Cl. ..... 347/93; 347/85; 347/65; 347/84

(58) Field of Classification Search ..... 347/93, 347/85, 71, 72, 65, 54, 68, 70, 84, 86
See application file for complete search history.

(56) References Cited

U.S. PATENT DOCUMENTS 5,489,930 A 2/1996 Anderson ..... 347/71
5,610,645 A * 3/1997 Moore et al. ..... 347/93
5,640,184 A 6/1997 Moynihan et al. ..... 347/47
5,709,581 A * 1/1998 Rothbarth et al. ..... 446/171
5,907,338 A 5/1999 Burr et al. ..... 347/43

(Continued)

FOREIGN PATENT DOCUMENTS

DE 19731551 A1 * 1/1999
EP 0 965 452 A1 12/1999

(Continued)

*Primary Examiner*—Stephen D Meier
*Assistant Examiner*—Leonard S Liang
(74) *Attorney, Agent, or Firm*—Oliff & Berridge, PLC

(57) ABSTRACT

An ink-jet head comprises a passage unit with an ink passage formed therein and a branching passage unit, and is constructed by laminating the passage unit and the branching passage unit with each other. The ink passage extends from a common ink chamber for supplying ink to a pressure chamber toward a nozzle. The branching passage unit includes an ink branching passage for branching ink from an ink introduction port to ink outlet ports. The outlet ports leads out ink into the passage unit. Inlet ports for introducing ink into the common ink chamber are formed on a surface of the passage unit. Ink outlet ports in the branching passage unit are disposed so as to face the inlet ports. Filters for removing foreign matters mixed in ink are formed in the ink branching passage within the branching passage unit.

9 Claims, 13 Drawing Sheets

U.S. PATENT DOCUMENTS

| | | | | |
|---|---|---|---|---|
| 5,940,957 | A * | 8/1999 | Goto et al. | 29/611 |
| 6,086,195 | A * | 7/2000 | Bohorquez et al. | 347/93 |
| 6,254,229 | B1 * | 7/2001 | Bohorquez et al. | 347/93 |
| 6,652,083 | B2 * | 11/2003 | Ison et al. | 347/93 |
| 6,814,937 | B1 | 11/2004 | Hirota et al. | 422/100 |
| 6,986,571 | B2 * | 1/2006 | Dudenhoefer et al. | 347/93 |
| 7,188,942 | B2 * | 3/2007 | Haines et al. | 347/93 |
| 2002/0017511 | A1 | 2/2002 | Kling | |
| 2002/0085067 | A1 | 7/2002 | Palifka et al. | 347/71 |
| 2002/0175976 | A1 | 11/2002 | Okuda | 347/71 |
| 2002/0196315 | A1 | 12/2002 | Isono et al. | 347/71 |

FOREIGN PATENT DOCUMENTS

| | | | |
|---|---|---|---|
| EP | 1 338 419 | A1 | 8/2003 |
| JP | 57056808 | A * | 4/1982 |
| JP | A 2-38054 | | 2/1990 |
| JP | A 2-198851 | | 8/1990 |
| JP | A 6-255101 | | 9/1994 |
| JP | A 6-328685 | | 11/1994 |
| JP | A 07-071761 | | 3/1995 |
| JP | A 8-187736 | | 7/1996 |
| JP | A 8-197736 | | 8/1996 |
| JP | A 8-244248 | | 9/1996 |
| JP | A 9-1805 | | 1/1997 |
| JP | A-09-150528 | | 6/1997 |
| JP | A 10-6514 | | 1/1998 |
| JP | A-10-068482 | | 3/1998 |
| JP | A 10-138485 | | 5/1998 |
| JP | Y2 2577996 | | 5/1998 |
| JP | A 10-337867 | | 12/1998 |
| JP | A-11-125377 | | 5/1999 |
| JP | A-11-315982 | | 11/1999 |
| WO | WO 2005102496 | A2 * | 11/2005 |

* cited by examiner

INK-JET HEAD, FILTER ASSEMBLY USED FOR MANUFACTURING THE INK-JET HEAD, AND METHOD FOR MANUFACTURING THE INK-JET HEAD USING THE FILTER ASSEMBLY

This is a Divisional of application Ser. No. 10/667,495 filed Sep. 23, 2003. The entire disclosure of the prior application is hereby incorporated by reference herein in its entirety.

BACKGROUND OF THE INVENTION

1. Field of the Invention

The present invention relates to an ink-jet head for ejecting ink onto a record medium to print, a filter assembly used for the ink-jet head, and a method for manufacturing the ink-jet head using the filter assembly.

2. Description of Related Art

In an ink-jet head, ink in an ink tank is lead to a supply passage, a common ink chamber, a pressure chamber, and then to a nozzle for ejecting the ink. Such a ink passage is formed by laminating a plurality of plates each formed with grooves or holes.

An ink-jet head, in terms of printing quality, needs to include a filter for removing foreign matters mixed in ink. Thus, there are known such techniques that a filter is formed in a plate serving as a boundary between a supply passage and a common ink chamber, among the plurality of plates constituting the above-mentioned ink passage (See Japanese Patent Laid-Open No. 6-255101), and that a filter is formed in a communicating region of a common ink chamber and a pressure chamber (See Japanese Patent Laid-Open No. 2-198851).

However, in case that a filter is formed in a plate serving as a boundary between a supply passage and a common ink chamber, the filter needs to be formed corresponding to each common ink chamber, and in case that a filter is formed in a communicating region of a common ink chamber and a pressure chamber, the filter needs to be formed corresponding to each pressure chamber. As a result, each filter becomes relatively small in size and relatively large in number. In these cases, a dimensional error of the filter is often caused. This dimensional error causes a variation of passage resistance in the individual ink passage each corresponding to an individual nozzle, thereby leading to deterioration of printing quality.

SUMMARY OF THE INVENTION

An object of the present invention is to provide an ink-jet head capable of realizing an improved printing quality by restraining a variation of passage resistance in the individual ink passage, a filter assembly used for the ink-jet head, and method for manufacturing the ink-jet head using the assembly.

According to a first aspect of the present invention, an ink-jet head comprises a passage unit including a plurality of nozzles for ejecting ink, a plurality of pressure chambers each connected to each of the nozzles, a common ink chamber for supplying ink to the pressure chambers, and inlet ports for introducing ink into the common ink chamber; and a branching passage unit including an ink introduction port into which ink is introduced, ink outlet ports formed to correspond to the inlet ports and leading out ink to the inlet ports, an ink branching passage for branching ink from the ink introduction port to the ink outlet ports, and an ink filter formed in the ink branching passage.

With this construction in which the filter is formed in the ink branching passage in the branching passage unit, the filter can be made larger in size and smaller in number in comparison with a case where a filter is formed in the passage unit such as between the inlet port and the common ink chamber, between the common ink chamber and the pressure chamber, and the like. Thus, the filters can be integrated. Accordingly, dimensional errors of the filters are not easily caused, and therefore a variation of passage resistance in the individual ink passage is restrained, to realize an improved printing quality.

According to a second aspect of the present invention, a filter assembly used for an ink-jet head, the ink-jet head comprising a passage unit including a plurality of nozzles for ejecting ink, a plurality of pressure chambers each connected to each of the nozzles, a common ink chamber for supplying ink to the pressure chambers, and inlet ports for introducing ink into the common ink chamber; and a plurality of filter supporting members arranged on a surface of the passage unit so that each filter supporting member covers the inlet ports, the filter assembly comprises the plurality of filter supporting members disposed to neighbor each other; interconnecting portions for connecting the neighboring filter supporting members with each other, bending strength on a boundary between the interconnecting portion and the filter supporting member being smaller than bending strength of the filter supporting member; and a filter formed in each of the plurality of filter supporting members.

According to a third aspect of the present invention, a method for manufacturing an ink-jet head, comprises steps of: forming a passage unit including a plurality of nozzles for ejecting ink, a plurality of pressure chambers each connected to each of the nozzles, a common ink chamber for supplying ink to the pressure chambers, and inlet ports for introducing ink into the common ink chamber; manufacturing a filter assembly comprising a plurality of filter supporting members disposed to neighbor each other, interconnecting portions for connecting the neighboring filter supporting members with each other, and a filter formed in each of the plurality of filter supporting members, bending strength on a boundary between the interconnecting portion and the filter supporting member being smaller than bending strength of the filter supporting member; separating the plurality of filter supporting members from each other by bending the interconnecting portions on the boundaries between the interconnecting portions and the filter supporting members; and arranging the plurality of filter supporting members on a surface of the passage unit such that the filter may face each of the inlet ports.

With the above second and third aspects, the ink-jet head according to the first aspect can relatively easily be realized by separating the plurality of filter supporting members included in the filter assembly from each other, and then disposing each of the filter supporting member on the passage unit so that the filer may face the inlet port formed on the surface of the passage unit. Therefore, the same advantage as the above first aspect, i.e., restraint of variation of passage resistance in the individual ink passage in the ink-jet head and improvement of printing quality, can be obtained.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
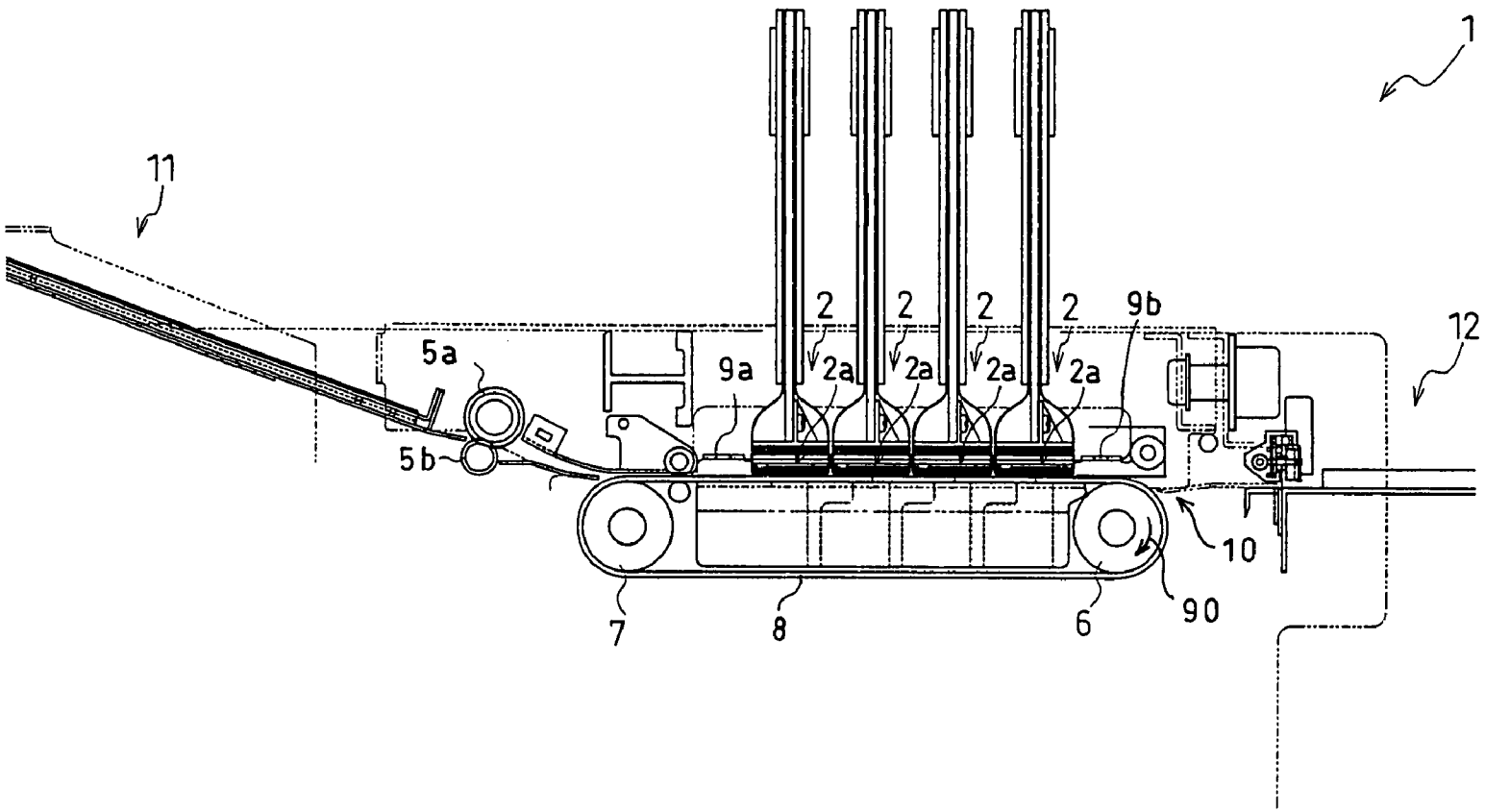
FIG. 1 illustrates a general construction of an example of a printer including ink-jet heads according to a first embodiment of the present invention.

FIG. 1 illustrates a general construction of an example of a printer including ink-jet heads according to a first embodiment of the present invention. The ink-jet printer 1 according to the present embodiment is a color ink-jet printer having four ink-jet heads 2. Within the ink-jet printer 1, a paper feed unit 11 and a paper discharge unit 12 are provided in left and right portions of FIG. 1, respectively. A paper conveyance path is formed extending from the paper feed unit 11 to the paper discharge unit 12 within the ink-jet printer 1.

A pair of paper feed rollers 5*a* and 5*b* are disposed immediately downstream of the paper feed unit 11 for putting forward paper as a medium from left to right in FIG. 1. In a middle of the paper conveyance path, two belt rollers 6 and 7 and a looped conveyor belt 8 are provided. The conveyor belt 8 is wrapped around each of the belt rollers 6 and 7 as to be stretched between them.

The conveyor belt 8 has a two-layered structure made up of a polyester base body impregnated with urethane and a silicone rubber. The silicone rubber is disposed in an outer portion of the conveyor belt 8 to form a conveyor face. Paper fed through the pair of paper feed rollers 5*a* and 5*b* is kept on the conveyor face of the conveyor belt 8 by holding power. In this state, the paper is conveyed downstream, i.e., rightward in FIG. 1, by driving one belt roller 6 to rotate clockwise in FIG. 1 as indicated by an arrow 90.

Pressing members 9*a* and 9*b* are respectively provided at positions for feeding paper onto the conveyor belt 8 and for discharging the paper from the conveyor belt 8, respectively. Either of the pressing members 9*a* and 9*b* is for pressing the paper onto the conveyor face of the conveyor belt 8 so as to prevent the paper from separating from the conveyor face. Thus, the paper is surely kept on the conveyor face.

A peeling device 10 is provided in the paper conveyance path immediately downstream of the conveyor belt 8, i.e., on the right in FIG. 1. The peeling device 10 peels off the paper, which has been kept on the conveyor face of the conveyor belt 8 by holding power, from the conveyor face, so that the paper can be transferred toward the rightward paper discharge unit 12.

Figure 2:
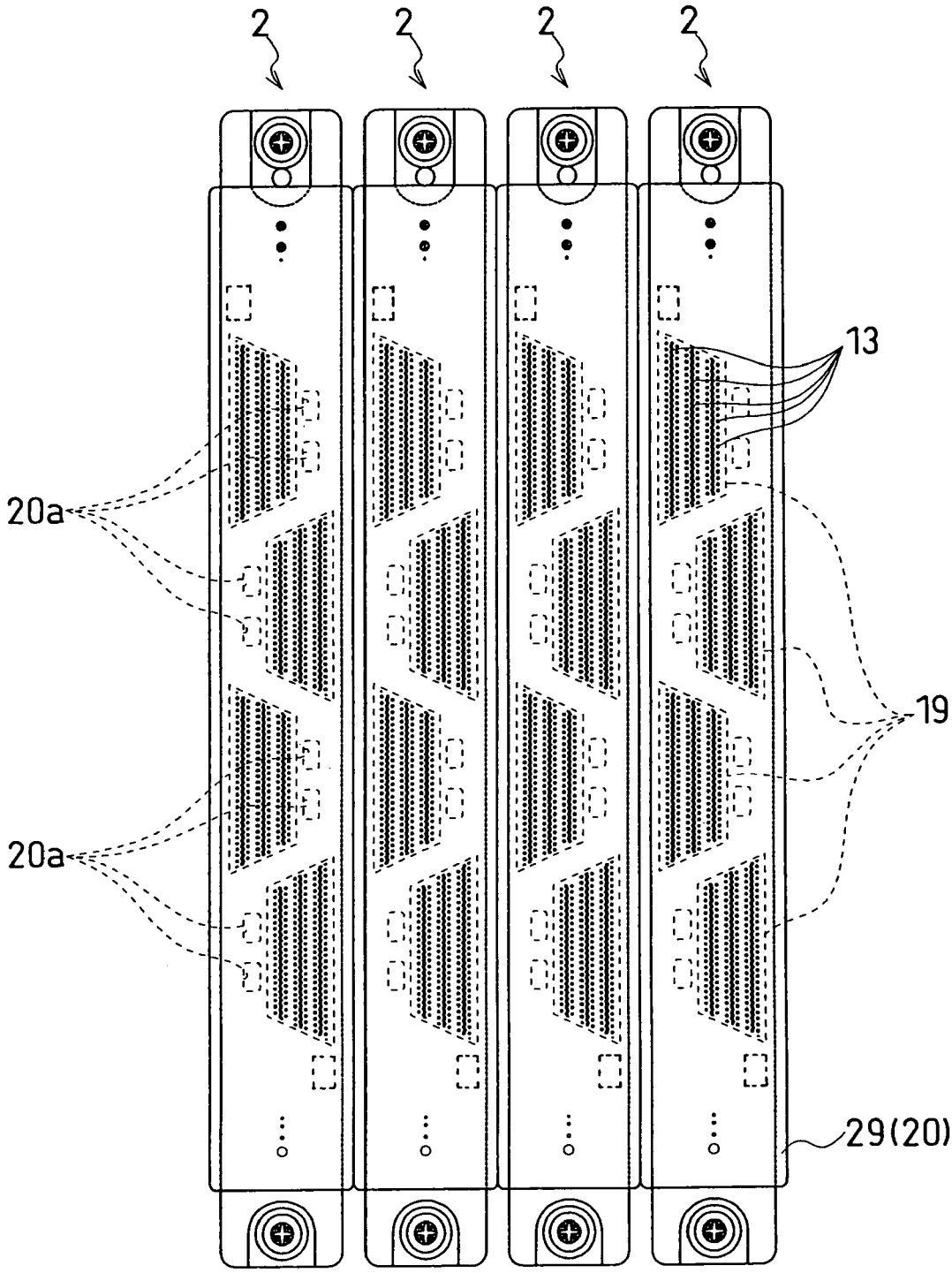
FIG. 2 is a bottom view of the ink-jet heads arranged in parallel and illustrated in FIG. 1.

Each of the four ink-jet heads 2 has, at its lower end, a head main body 2*a*. Each head main body 2*a* has a rectangular section. The head main bodies 2*a* are arranged close to each other with the longitudinal axis of each head main body 2*a* being perpendicular to the paper conveyance direction, i.e., perpendicular to FIG. 1. That is, this printer 1 is a line type. The bottom of each of the four head main bodies 2*a* faces the paper conveyance path. In the bottom of each head main body 2*a*, a large number of nozzles are provided each having a small-diameter ink ejection port 13 (see FIG. 2). The four head main bodies 2*a* eject ink of magenta, yellow, cyan, and black, respectively.

The head main bodies 2*a* are disposed such that a narrow clearance is formed between the lower face of each head main body 2*a* and the conveyor face of the conveyor belt 8. The paper conveyance path is formed within the clearance. In this construction, while paper, which is being conveyed by the conveyor belt 8, passes immediately below the four head main bodies 2*a* in order, the respective color inks are ejected through the corresponding nozzles toward the upper face, i.e., the print face of the paper, to form a desired color image on the paper.

Figure 3:
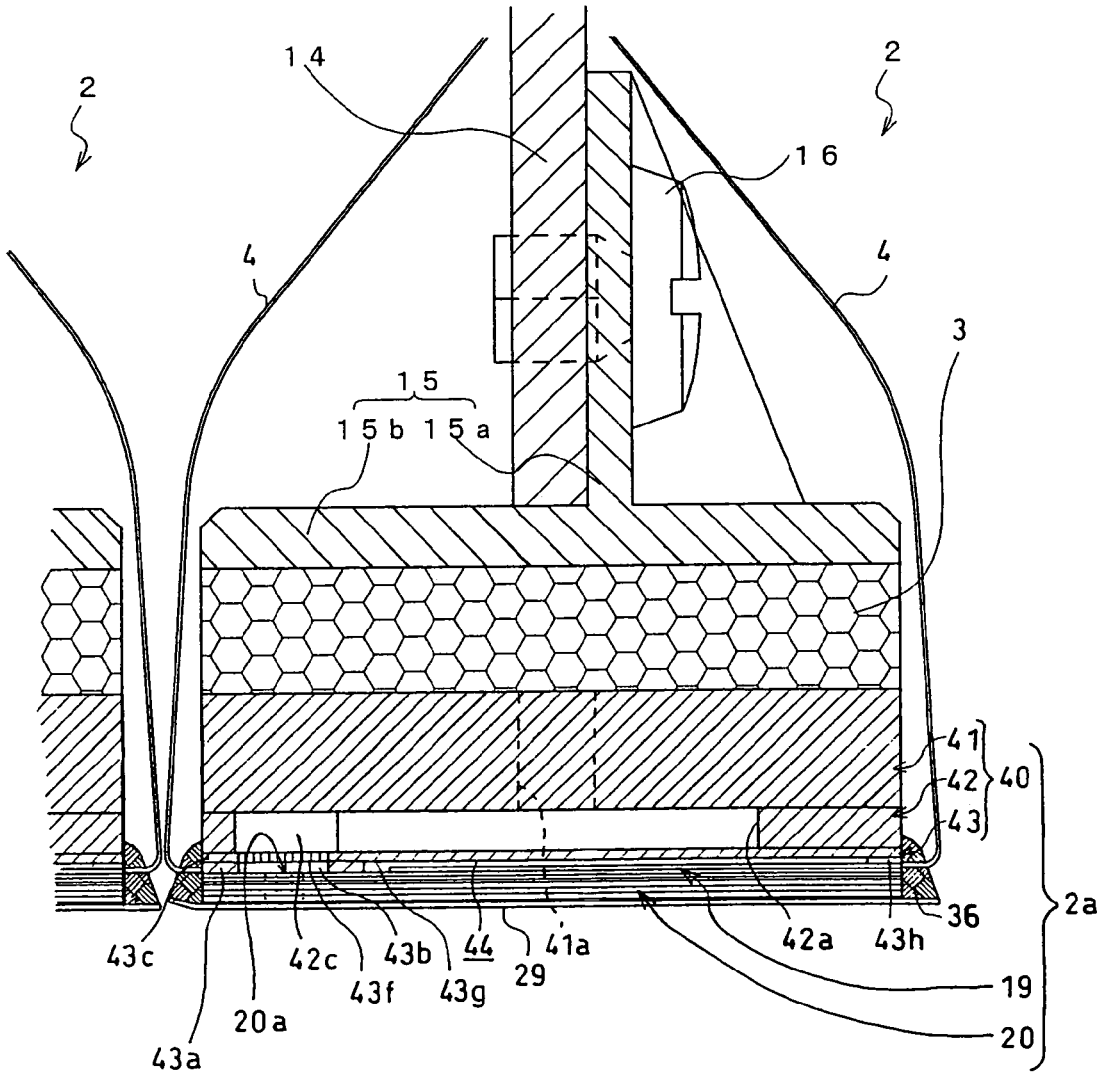
FIG. 3 is a partial sectional view of the ink-jet head illustrated in FIG. 1.

FIG. 3 illustrates a partial sectional view of the ink-jet head 2. The ink-jet head 2 is attached through a holder 15 to an adequate member 14 provided within the printer 1. The holder 15 has an inversed-T shape in a side view, made up of a vertical portion 15*a* and a horizontal portion 15*b*. The vertical portion 15*a* is fixed to the member 14 with a screw 16. The head main body 2*a* is fixed to the lower face of the horizontal portion 15*b* with a spacer 3 positioned therebetween. The head main body 2*a* includes, from the lower, a passage unit 20, an actuator unit (actuator) 19 fixed to a surface of the passage unit 20, and a branching passage unit 40 fixed to the surface of the passage unit 20 with the actuator unit sandwiched therebetween.

A construction of the branching passage unit 40 will here be described with reference to FIGS. 3 and 4.

The branching passage unit 40 is constituted by laminating a first plate 41, a second plate 42, and a third plate 43 with each other. Among these three plates 41 to 43, the first plate 41 and the second plate 42 are made of metal such as stainless steel, and the third plate 43 is formed by a metal plate 43*a* such as a plate of stainless steel and a resin plate 43*c* such as a plate of polyimide being laminated with each other. The third plate 43 is arranged so that the metal plate 43*a* may face the passage unit 20.

Figure 4:
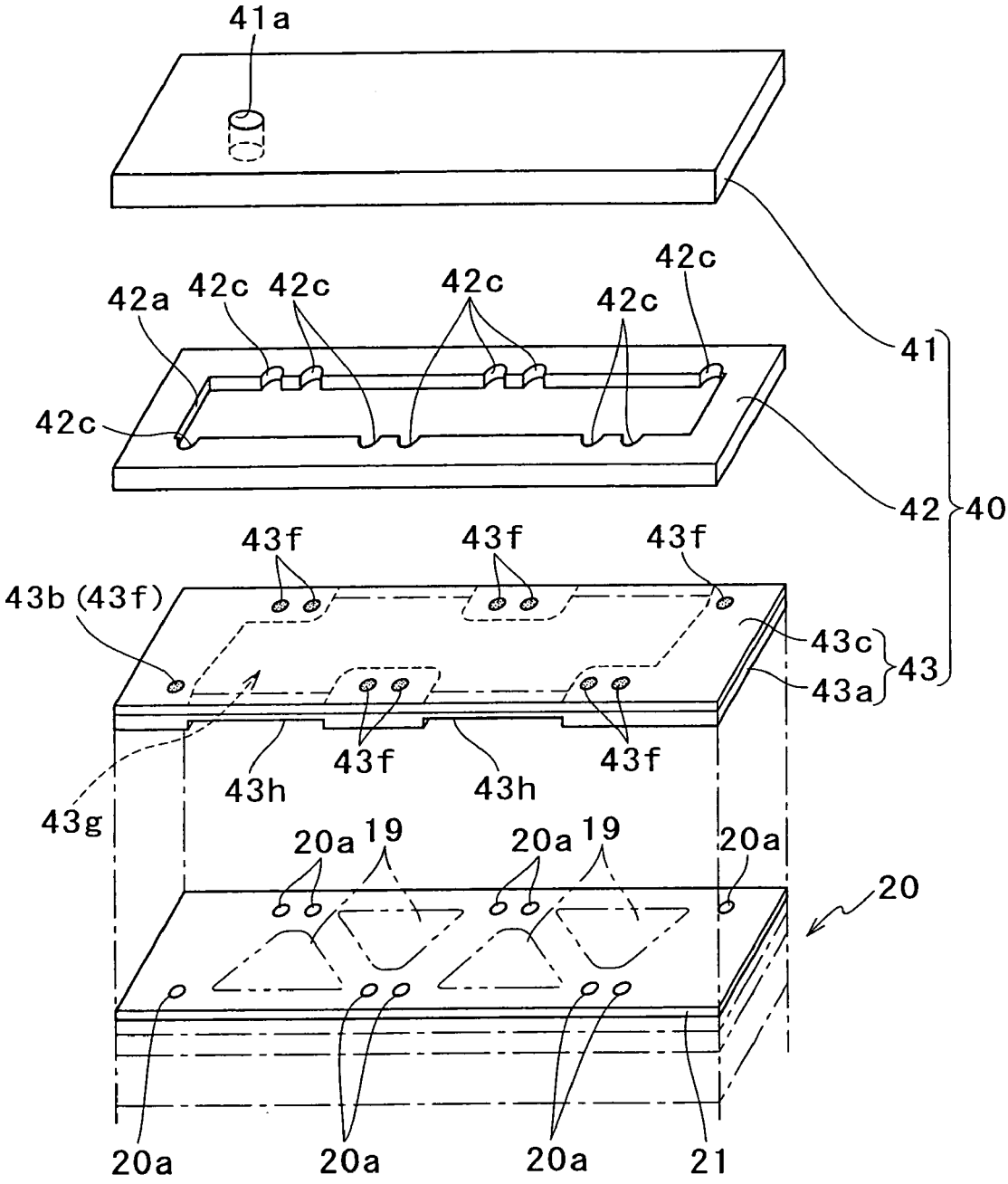
FIG. 4 is an exploded perspective view of a branching passage unit illustrated in FIG. 3.
Figure 5A:
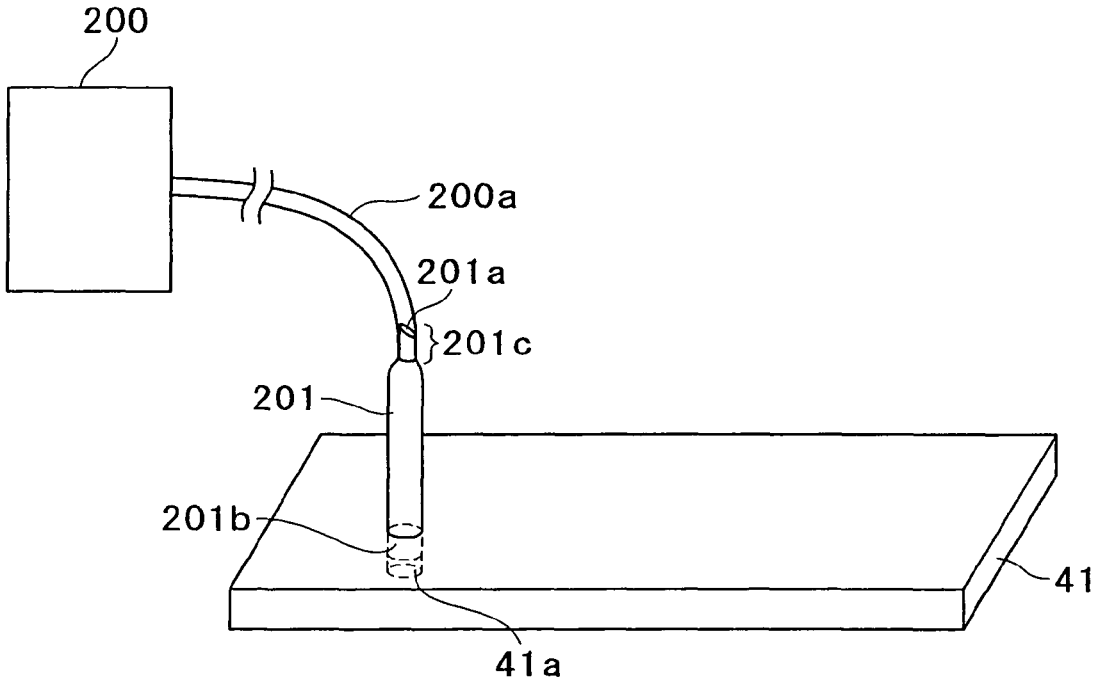
FIG. 5A is a partial perspective view illustrating an example of methods for introducing ink from an ink supply source into an ink introduction port.

Referring to FIG. 4, at a widthwise center on one side of the first plate 41 in a longitudinal direction thereof, formed by etching, etc., is an ink introduction port 41*a* penetrating through the plate in its thickness direction. Ink is introduced from an ink supply source 200 such as an ink tank into the ink introduction port 41*a*, for example as illustrated in FIG. 5A, through a cylindrical member 201 and a tube 200*a* connected to the cylindrical member 201.

Figure 5B:
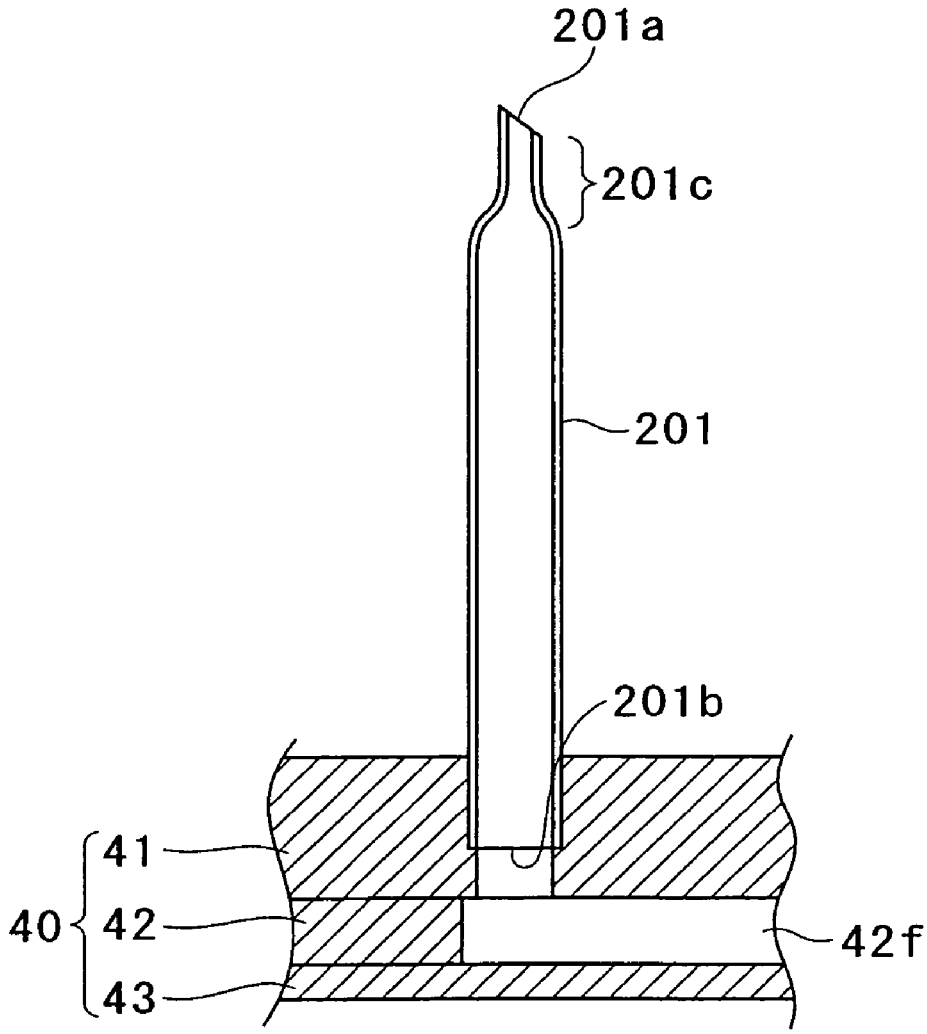
FIG. 5B is a partial sectional view of a cylindrical member and the branching passage unit illustrated in FIG. 5A.

As illustrated in FIG. 5B, the cylindrical member 201 has a cylindrical base 201*b* and a reduced diameter portion 201*c* on an opposite of the base 201*b*. The reduced diameter portion

201*c* has a reduced diameter and a tip 201*a* formed in a tapered shape. The base 201*b* is press-fitted into the ink introduction port 41*a*, and an end of the tube 200*a* extending from the ink supply source 200 is externally fitted to an outer peripheral surface of the reduced diameter portion 201*c*. When a portion of the cylindrical member 201 to which the tube 200*a* is attached (the reduced diameter portion 201*c*) is thus formed in the tapered shape, the tube 200 can easily be attached. Moreover, in case that the tube 200*a* is omitted and the ink supply source 200 is directly attached to the cylindrical member 201, an attachment can easily be performed likewise.

The cylindrical member 201 is preferably made of the same material as that of the first plate 41. In this case, since the cylindrical member 201 and the first plate 41 have the same linear expansion coefficients, they expand and contract in the same way due to changes in temperature, humidity, and the like. Accordingly, tight-coupling between the cylindrical member 201 and the first plate 41 can be kept well. Thus, air inflow through a gap between the base 201*b* of the cylindrical member 201 and the ink introduction port 41*a* can be prevented.

More preferably, the cylindrical member 201 and the first plate 41 are both made of stainless steel. Since stainless steel has an excellent ink resistance, various types of ink may be used. Stainless steel is also excellent in air barrier properties. Therefore, it can be prevented that air passes the cylindrical member 201 and the ink introduction port 41*a* to generate bubbles in an ink branching passage in the branching passage unit 40.

In the second plate 42, as illustrated in FIGS. 3 and 4, a hole to constitute an ink reservoir 42*a* for storing ink is formed, by press working, etc., along a longitudinal direction of the second plate 42 (direction perpendicular to FIG. 3). Further, a plurality of notches 42*c* having nearly semicylindrical shape are serially formed at sidewalls of the hole to constitute the ink reservoir 42*a*, as illustrated in FIG. 4.

At portions of the metal plate 43*a* in the third plate 43 corresponding to below-described inlet ports 20*a* in the passage unit 20, formed are ink outlet ports 43*b* having the same shape as that of the inlet port 20*a* and penetrating through the plate in its thickness direction (see FIG. 3). The portions where the ink outlet ports 43*b* are formed also correspond to the notches 42*c* in the second plate 42 illustrated in FIG. 4.

At portions of the resin plate 43*c* in the third plate 43 corresponding to the below-described inlet ports 20*a* in the passage unit 20, i.e., corresponding to the above-mentioned ink outlet ports 43*b*, formed are ink filters 43*f* having the same shape as that of the inlet port 20*a* and the ink outlet port 43*b*.

The ink outlet ports 43*b* are formed by etching the metal plate 43*a*, and subsequently, the filters 43*f* are formed by making, with excimer laser machining, a large number of small-diameter pores (16 to 24 micrometers) to neighbor each other concentratedly at the portions of the resin plate 43*c* corresponding to the ink outlet ports 43*b*.

Further, a part of the metal plate 43*a* in the third plate 43 is cut off by etching, etc., and remaining are only areas including the ink outlet ports 43*b*, which is indicated by dotted lines in FIG. 4. Thus, a concavity 43*g* is formed in the third plate 43 facing the passage unit 20. As illustrated in FIG. 3, the concavity 43*g* forms a space 44 in which the actuator unit 19 (illustrated on the surface of the passage unit 20 with alternate long and two short dashes lines in FIG. 4) is to be arranged. Protrusions 43*h* protruding toward the passage unit 20 is formed at areas of the metal plate 43*a* corresponding to outsides of long sides of the actuator units 19 (areas outside of alternate long and short dash lines in FIG. 4) (see FIG. 3). The protrusion 43*h* has such a height that a below-described flexible printed circuit (FPC) 4 may be drawn out from the space 44 to the outside. The protrusion 43*h* closes the space 44.

The number of processing steps can be reduced by performing two etchings in the metal plate 43*a* at the same time, i.e., the etching for forming the concavity 43*g* and the etching for forming the ink outlet ports 43*b*.

The above-described first to third plates 41 to 43 are laminated with each other, so that an ink branching passage for branching ink from the ink introduction port 41*a* to the ink outlet ports 43*b* is formed within the branching passage unit 40.

The passage unit 20 has circular inlet ports 20*a* (see FIGS. 2 and 3) facing the branching passage unit 40. The passage unit 20 is bonded to the branching passage unit 40 so that respective inlet ports 20*a* may communicate with respective portions corresponding to the notches 42*c* of the branching passage unit 40. Thus, ink in the ink reservoir 42*a* can flow into the passage unit 20 through the inlet ports 20*a*.

The actuator unit 19 is bonded to the upper face of the passage unit 20, and more specifically, in a region other than the region where the upper face of the passage unit 20 the branching passage unit 40 is bonded. The actuator units 19 is separated from the branching passage unit 40. That is, although the branching passage unit 40 is in contact with the passage unit 20 in the vicinity of the inlet port 20*a*, the branching passage unit 40 is spaced from the head main body 2*a* in the other region. The actuator unit 19 is disposed within the separation region. As illustrated with alternate long and two short dashes lines in FIG. 4, each actuator unit 19 has a substantially trapezoidal shape in plan. Actuator units 19 are arranged in a zigzag manner along the length of the head 2. Each actuator unit 19 is disposed so that its parallel opposite sides, i.e., the upper and lower sides, are along of the length of the passage unit 20. Oblique sides of each neighboring actuator units 19 overlap each other along the width of the passage unit 20. the region of the lower face of the passage unit 20 corresponding to a bonded region of each actuator unit 19 is made into an ink ejection region.

The inlet ports 20*a* in the passage unit 20 as described above are arranged so as to correspond to regions where no actuator unit 19 is disposed. In more detail, as shown in FIG. 4, the inlet ports 20*a* includes ones arranged countercorner at both ends in a longitudinal direction of the passage unit 20 and the other arranged with making pairs near respective short sides of opposing parallel sides of the actuator units 19 in a zigzag manner. Since the plurality of inlet ports 20*a* are arranged at a distance therebetween in the longitudinal direction of the passage unit 20, even if the head 2 is elongated, ink in the ink reservoir 42*a* can stably be supplied to the passage unit 20 with passage resistance restrained.

Figure 6:
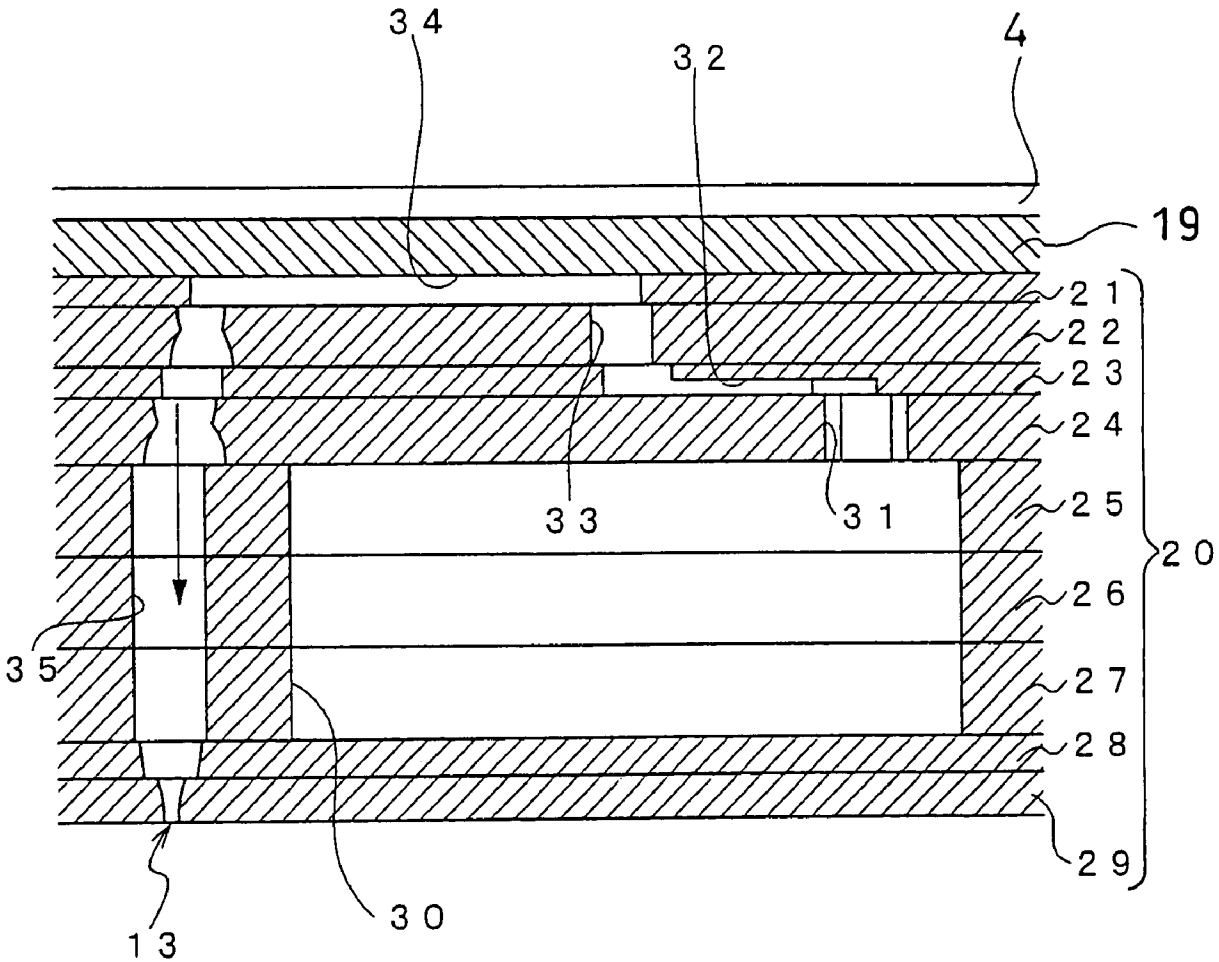
FIG. 6 is an enlarged sectional view of an ink passage in a passage unit illustrated in FIG. 3.

Next, an ink passage in the passage unit 20 will be described in more detail with reference to FIG. 6. FIG. 6 is an enlarged sectional view of an ink passage in a passage unit illustrated in FIG. 3.

The passage unit 20, as illustrated in FIG. 6, has a layered structure of nine metallic thin flat plates 21, 22, 23, 24, 25, 26, 27, 28, and 29. A manifold channel (common ink chamber) 30 is formed by the flat plates 25 to 27 in such a manner as to lie across these three plates, which constitute fifth to seventh layers from a top. The manifold channel 30 communicates with the above-described inlet ports 20*a* through a not-illustrated path. A communication hole 31 is formed in the fourth flat plate 24 disposed immediately on the manifold channel 30. The communication hole 31 connects with an aperture 32 formed in the third flat plate 23.

The aperture 32 communicates with one end of a pressure chamber 34 formed in the first flat plate 21 through a communication hole 33 formed in the second flat plate 22. The pressure chambers 34, which correspond to respective nozzles one by one, are for applying pressure to ink by means of a drive of the actuator unit 19 fixed onto an upper face of the passage unit 20. The other end of the pressure chamber 34 communicates with a nozzle of tapered shape formed in the ninth flat plate 29 through a nozzle communication hole 35 formed in the second to eighth flat plates to penetrate these seven plates. An ink ejection port 13 is formed at an front end of the nozzle.

A planer shape of the pressure chamber 34 is substantially of elongated diamond or of parallelogram (illustration is omitted).

In the head main body 2*a* having the above construction, as illustrated in FIG. 5A for example, ink introduced from the ink supply source 200 is firstly introduced through the ink introduction port 41*a* into the ink reservoir 42*a*, where the ink is reserved for a time. The ink in the ink reservoir 42*a* subsequently passes through the notches 42*c*, and then through the filters 43*f*. At this time, foreign matters mixed in the ink are removed by the filters 43*f*. The ink, after passing through the filters 43*f*, reaches the ink outlet ports 43*b* (see FIG. 4). The ink is then led from the ink outlet ports 43*b* into the inlet ports 20*a* in the passage unit 20, and further into the manifold channel 30. The ink in the manifold channel 30 is, as illustrated in FIG. 6, supplied to each pressure chamber 34 through the communication hole 31, the aperture 32, and the communication hole 33. A drive of the actuator unit 19, as described below, applies pressure to the ink in each pressure chamber 34 so that the ink is ejected from the ink ejection port 13 through the nozzle communication hole 35.

The actuator unit 19 is constructed by laminating a plurality of piezoelectric sheets made of a ceramic material such as lead zirconate titanate (PZT). Thin film electrodes made of, e.g., an Ag—Pd-base metallic material are interposed between the piezoelectric sheets, so that active portions are formed at regions facing respective pressure chambers 34. When a potential difference is caused between the electrodes arranged in the piezoelectric sheets in the below-described manner, each active portion deforms into a convex shape toward the pressure chamber 34. As a result, a volume of the pressure chamber 34 is reduced to apply pressure to the ink in the pressure chamber 34.

As illustrated in FIG. 6, an FPC 4, acting as a power supply member to the actuator unit 19, is bonded to an upper face of the actuator unit 19. As illustrated in FIG. 3, the FPC 4 is drawn out from a side of the ink-jet head main body 2*a*, bent upward, and electrically connected to a driver integrated circuit (IC) (not illustrated) mounted on a side face of the member 14. Drive pulses generated in the driver IC are supplied, through the FPC 4, to the electrodes in the actuator unit 19, so as to deform the above-described active portions. Such a potential control is performed corresponding to each pressure chamber 34 independently of one another.

Moreover, as illustrated in FIG. 3, a silicon-base seal member 36 is disposed at a side of the head main body 2*a* corresponding to an opening for drawing out the FPC 4. The seal member 36 serves to safeguard the FPC 4 as well as to seal the above-mentioned space 44 in order to prevent ink, etc., from entering the space 44.

As described above, in the ink-jet head 2 according to the present embodiment, since the ink filters 43*f* are formed in the ink branching passage within the branching passage unit 40, the filter can be made larger in size and smaller in number in comparison with a case where the filters are formed in the passage unit 20. Thus, the filters can be integrated. Accordingly, dimensional errors of the filters 43*f* are not easily caused, and therefore a variation of passage resistance in the individual ink passage is restrained, to realize an improved printing quality.

Also, in case that the filter is formed in the ink passage within the passage unit 20 (e.g., at the communication hole 31 or the throttle part 32), the flat plates 21 to 29 (see FIG. 6) need be positioned with each other with relatively strict accuracy in order to align a position of the filter with each part. In the present embodiment, on the other hand, there is not required so strict accuracy in positioning for surely passing ink through the filters 43*f*. Moreover, since a filter is not formed in the flat plates 21 to 29, the flat plates 21 to 29 constituting the passage unit 20 can relatively easily be positioned with each other. Therefore, the ink-jet head 2 can easily be manufactured, so as to realize an improved manufacture yield and reduced manufacture cost.

The filters 43*f* are formed in the plate 43, which is one of the plates constituting the branching passage unit 40. Thus, the filters 43*f* can be formed easily by, e.g., etching or excimer laser machining.

A use of excimer laser machining for forming the large number of pores constituting the filter 43*f* can, in comparison with etching, etc., stabilize shapes and sizes of the pores. Passage resistance in the individual ink passage is thereby stabilized.

Moreover, since the third plate 43 formed with the filters 43*f* has a layered structure laminated with the metal plate 43*a* and the resin, e.g., polyimide, plate 43*c*, the ink outlet ports 43*b* can be formed by etching the metal plate 43*a*, and at the same time, the filters 43*f* can easily be formed by making a large number of pores, with excimer laser machining, at the portions of the resin plate 43*c* corresponding to the ink outlet ports 43*b*. In the above-described method for forming filters, a manufacture cost of the filter 43*f* can be reduced.

In this case, additionally, strength of the filter 43*f* can be well maintained compared with a case where the filter is formed in a single plate, because the resin plate 43*c* is backed with the metal plate 43*a*. Since the third plate 43 thereby advantageously has good strength, laminating of the third plate 43 and the second plate 42 can easily be performed.

Further, the filters 43*f* are disposed between the ink reservoir 42*a* and the ink outlet port 43*b*. More specifically, the filters 43*f* are formed at portions of the third plate 43 having the ink outlet ports 43*b*, corresponding to respective ink outlet ports 43*b*, among the plates constituting the branching passage unit 40. Ink once reserved in the ink reservoir 42*a* flows through the notches 42*c* into the filters 43*f*, and then reaches ink outlet ports 43*b*. In this case, passage resistance does not largely vary before and after the ink passes through the filters 43*f*, i.e., while the ink flows from the notches 42*c* into the ink outlet ports 43*b*. Therefore, the ink can flow smoothly, without generating bubbles in passing the filters 43*f*.

Figure 7:
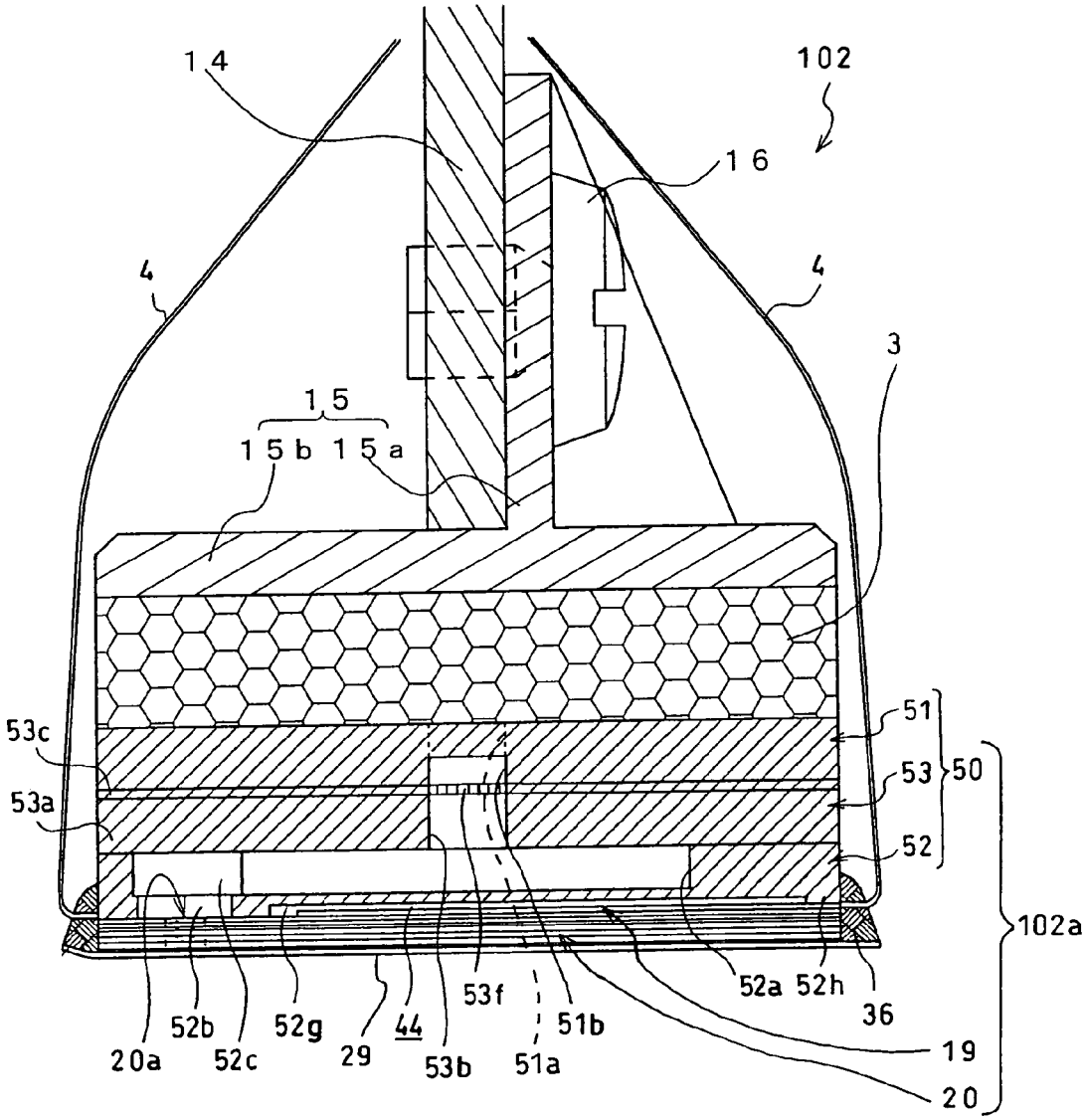
FIG. 7 is a partial sectional view, corresponding to FIG. 3, of an ink-jet head according to a second embodiment of the present invention.

Next, an ink-jet head according to a second embodiment of the present invention will be described with reference to FIGS. 7 and 8. An ink-jet head 102 of the present embodiment differs from that of the first embodiment only in its branching passage unit. The other components, such as a passage unit 20, etc., are identical to those of the first embodiment, and therefore, will not be described by designating them by common reference numerals.

A branching passage unit 50 is constituted by laminating with each other a first plate 51, a second plate 52, and a third plate 53 disposed between the first plate 50 and the second plate 52. Among these three plates 51 to 53, the first plate 51 and the second plate 52 are made of metal such as stainless steel, and the third plate 53 is formed by a metal plate 53*a* such as a plate of stainless steel and a resin plate 53*c* such as a plate of polyimide being laminated with each other. The third plate 53 is arranged so that the metal plate 53*a* may face the second plate 52.

Figure 8:
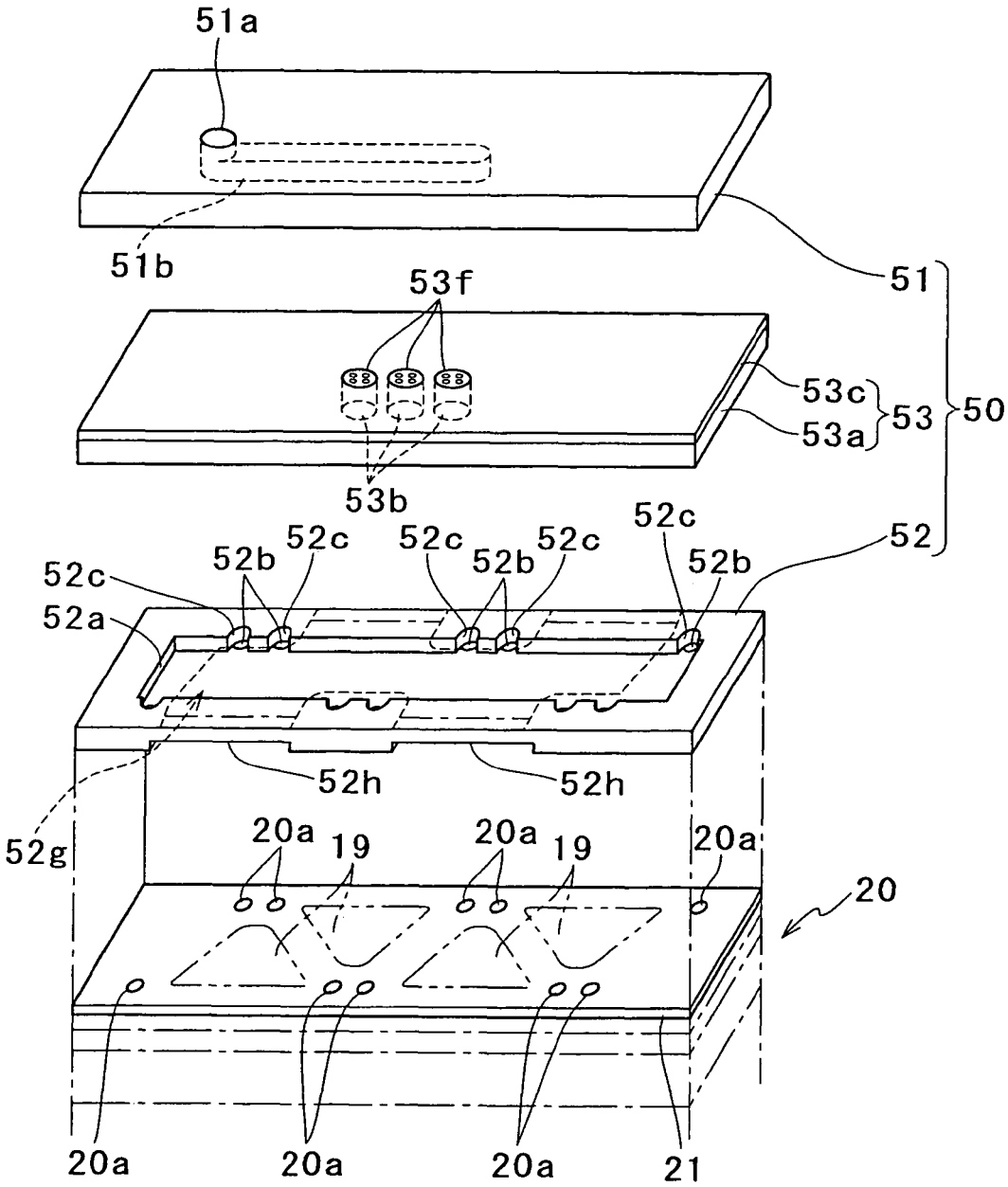
FIG. 8 is an exploded perspective view, corresponding to FIG. 5, of a branching passage unit in the ink-jet head illustrated in FIG. 7.

Referring to FIG. 8, at a widthwise center on one side of the first plate 51 in a longitudinal direction thereof, formed by etching, etc., is an ink introduction port 51*a* penetrating through the plate in its thickness direction. Similarly to the first embodiment, ink is introduced from an ink supply source 200 (see FIG. 5A) such as an ink tank into the ink introduction port 51*a*. Further, as shown in FIG. 8, a slot 51*b* is formed in the first plate 51 facing the third plate 53. One end of the slot 51*b* is connected to the ink introduction port 51*a*, and the other end extends to substantially a middle of the plate in its longitudinal direction.

Three reservoir communication holes 53*b* neighboring each other along a longitudinal direction of the plate are formed at a substantial center of the metal plate 53*a* in the third plate 53, i.e., at a portion to be a substantial center of a below-described ink reservoir 52*a*. Filters 53*f* having a large number of pores and the same shape as that of the reservoir communication holes 53*b* are formed at portions of the resin plate 53*c* in the third plate 53, corresponding to the reservoir communication holes 53*b*.

The reservoir communication holes 53*b* are formed by etching the metal plate 53*a*, and subsequently, the filters 53*f* are formed by making, with excimer laser machining, a large number of small-diameter pores (16 to 24 micrometers) to neighbor each other concentratedly at the portions of the resin plate 53*c* corresponding to the reservoir communication holes 53*b*.

In the second plate 52 facing the third plate 53, formed by half etching, etc., is a concavity to constitute an ink reservoir 52*a* having the same planer shape as that of the hole to constitute the ink reservoir 42*a* in the first embodiment (see FIG. 4). Moreover, notches 52*c* having the same planer shape as that of the notches 42*c* in the first embodiment (see FIG. 4) are serially formed, by half etching, etc., at sidewalls of the concavity to constitute the ink reservoir 52*a*. Further, at vicinities of the notches 52*c* corresponding to the inlet ports 20*a* of the passage unit 20, formed are ink outlet ports 52*b* having the same shape as that of the inlet ports 20*a* and penetrating through the plate in its thickness direction.

A concavity 52*g* having the same planer shape as that of the concavity 43*g* in the first embodiment (see FIG. 4) is formed, by half etching, etc., in the second plate 52 facing the passage unit 20. Protrusions 52*h* similar to the protrusions 43*h* in the first embodiment is formed at areas of the second plate 52 corresponding to outsides of long sides of actuator units 19 (areas outside of alternate long and short dash lines in FIG. 8) (see FIG. 7).

The above-described first plate 51, the second plate 52, and the third plate 53 disposed between these two plates are laminated with each other, so that an ink branching passage for branching ink from the ink introduction port 51*a* to the ink outlet ports 52*b* is formed within the branching passage unit 50.

In the head main body 102*a* having the above construction, as illustrated in FIG. 5A for example, ink introduced from the ink supply source 200 is firstly introduced from the ink introduction port 51*a* into the slot 51*b*, and then passes through the filters 53*f*. At this time, foreign matters mixed in the ink is removed by the filters 53*f*. The ink having passed through the filters 53*f* is introduced through the reservoir communication holes 53*b* into the ink reservoir 52*a*, where the ink is reserved for a time. The ink in the ink reservoir 52*a* is subsequently led, through the notches 52*c*, from the ink outlet ports 52*b* into the inlet ports 20*a* in the passage unit 20, and then introduced into a manifold channel 30. The ink flows from the manifold channel 30 to an ink ejection port 13 in the same manner as in the first embodiment. Thus, the description of the ink flow thereafter is omitted.

As described above, in the ink-jet head 102 according to the present embodiment, since the ink filter 53*f* is disposed between the ink introduction port 51*a* and the ink reservoir 52*a*, the filter can be made further larger in size and smaller in number, in comparison with a case of the first embodiment and a case where the filter is formed in the passage unit 20. Thus, the filters can be further integrated, so as to surely obtain the effect that a variation of passage resistance in the individual ink passage is restrained to realize an improved printing quality.

Moreover, since the filters 53*f* are formed at the portion to be a substantial center of the ink reservoir 52*a*, the excimer laser machining, etc., can performed more easily and processing time thereof can be shortened, as compared with the first embodiment.

Moreover, the construction in which the filter is disposed between the ink introduction port 51*a* and the ink reservoir 52*a* can provide wide variance in position, number, and shape, etc., of the filter. Accordingly, the filter can be formed at a position different from the position of the filter 53*f* in the second embodiment, and the number, size, and shape, etc., of the filter may properly be changed. When the filter is made smaller in number and larger in size, for example, a reduction of passage resistance in ink passages can further be restrained, and additionally, ink is prevented from inconveniently clogging at pores constituting the filter. Moreover, deficiencies in pores may frequently be caused in case of making a large number of small-diameter pores by etching, etc. In the present embodiment, however, this problem of deficiencies in pores can be decreased by enlarging the size of the filter. Further, it is also possible to give the filter a size and shape advantageous in strength.

In addition, the same effects as those of the first embodiment described above can be obtained due to the constructions where a filter is not formed in the flat plates 21 to 29 constituting the passage unit 20 (see FIG. 6), where the filters 53*f* are formed in the plate 53, which is one of the plates constituting the branching passage unit 50, and where the third plate 53 formed with the filters 53*f* has a layered structure laminated with the metal plate 53*a* and the resin plate 53*c*.

Next, an ink-jet head according to a third embodiment of the present invention will be described with reference to FIGS. 9 to 12. An ink-jet head 202 of the present embodiment differs from those of the first and second embodiments only in its branching passage unit. The other components, such as a passage unit 20, etc., are identical to those of the first embodiment, and therefore, will not be described by designating them by common reference numerals.

Figure 9:
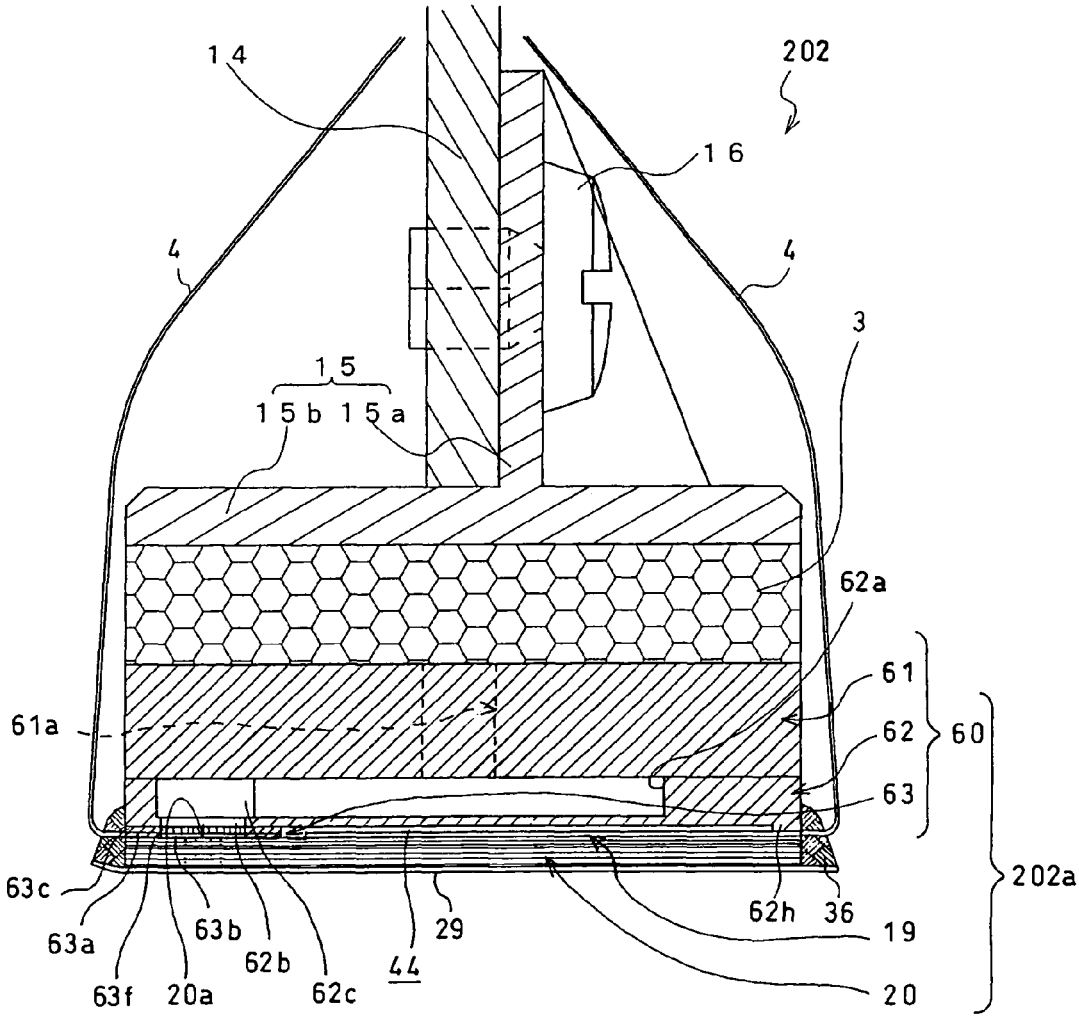
FIG. 9 is a partial sectional view, corresponding to FIG. 3, of an ink-jet head according to a third embodiment of the present invention.
Figure 10:
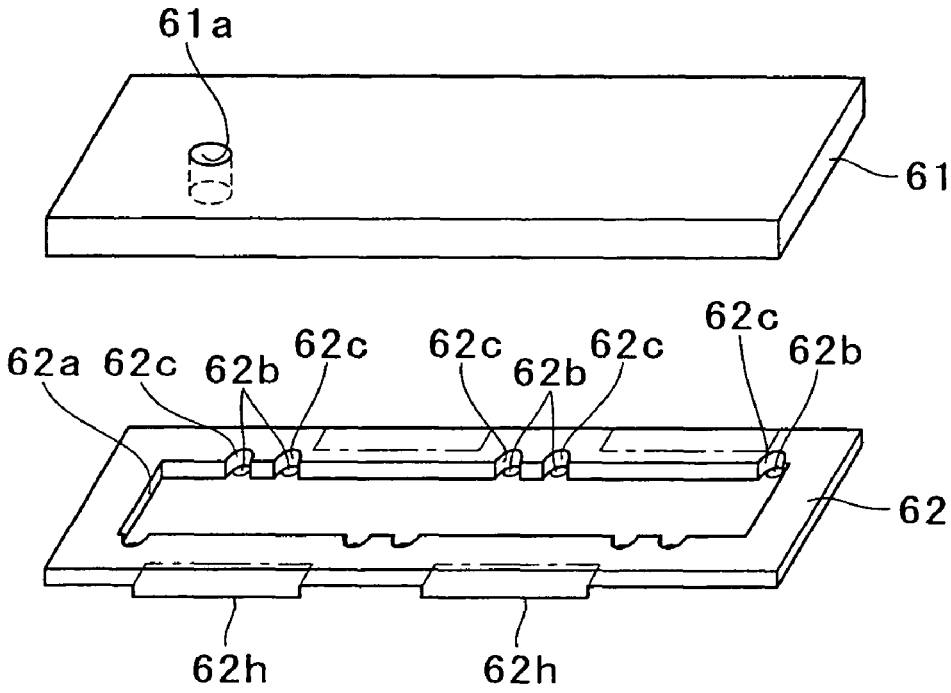
FIG. 10 is an exploded perspective view, corresponding to FIG. 5, of a part of a branching passage unit in the ink-jet head illustrated in FIG. 9.

As illustrated in FIG. 9, a branching passage unit 60 includes a first plate 61, a second plate 62, and filter supporting members 63. The first plate 61 and the second plate 62 are made of metal such as stainless steel. The first plate 61 and the second plate 62, having almost the same shape, are laminated with each other, as illustrated in FIG. 10. On the other hand, the filter supporting members 63, which are included in a below-described filter assembly 73 (see FIG. 11), are arranged so as to cover respective inlet ports 20*a* on a surface of the passage unit 20, as illustrated in FIG. 12. The second plate 62 is disposed on the filter supporting members 63.

The first plate 61 is, as shown in FIG. 10, identical to the first plate 41 in the first embodiment, and has an ink introduction port 61*a* at a widthwise center on one side of the plate in a longitudinal direction.

A concavity to constitute an ink reservoir 62*a* and notches 62*c* are formed in the second plate 62 facing the first plate 61. The concavity to constitute the ink reservoir 62*a* and the notches 62*c* are similar to the concavity to constitute the ink reservoir 52*a* and notches 52*c* in the second embodiment (see FIG. 8), respectively. Further, similarly to the ink outlet ports 52*b* in the second embodiment, ink outlet ports 62*b* penetrating through the plate in its thickness direction are formed at vicinities of the notches 62*c*.

Protrusions 62*h* are formed at areas enclosed with alternate long and short dash lines in FIG. 10, facing the passage unit 20. Portions other than the protrusions 62*h* exist on the same plane. Similarly to the protrusions 42*h* and 52*h* in the first and second embodiments, the protrusion 62*h* has such a height that an FPC 4 may be drawn out from a space 44 to the outside. The protrusion 62*h* closes the space 44 in which an actuator unit 19 is to be arranged (see FIG. 9). The space 44 is formed at a portion where the filer supporting members 63 are not arranged when the second plate 62 is fixed to the passage unit 20 with the filter supporting members 63 sandwiched therebetween.

The filter assembly 73 used for the ink-jet head 202 of the present embodiment will hereinafter be described with reference to FIG. 11.

The filter assembly 73 comprises four filter supporting members 63 disposed to neighbor each other, interconnecting portions 73*d* for interconnecting the neighboring filter supporting members 63, a frame portion 73*g* surrounding peripheries of the four filter supporting members 63, and peripheral connecting portions 73*e* for connecting the frame portion 73*g* and the filter supporting members 63 adjacent to the frame portion 73*g*.

Each interconnecting portion 73*d* has an elongated shape elongated in a direction of connecting the filter supporting members 63 with each other. A bending strength of a boundary between each interconnecting portion 73*d* and each filter supporting member 63 is smaller than a bending strength of the filter supporting members 63. A bending strength of a boundary between each peripheral connecting portion 73*e* and each filter supporting member 63 is also smaller than the bending strength of the filter supporting members 63.

Filters 63*f* corresponding to the respective inlet ports 20*a* (see FIG. 12) are formed in each of the four filter supporting members 63. Among the four filter supporting members 63, two filter supporting members 63 as disposed on this side in FIG. 11 are in generally rectangular shape, and each has two filters 63*f* corresponding to each pair of inlet ports 20*a*. Remaining two filter supporting members 63 are in generally L shape, and each has three filters 63*f* each corresponding to a pair of inlet ports 20*a* and a single inlet port 20*a* disposed opposite to that pair of inlet ports 20*a*.

The filter supporting members 63 are formed in such a shape as to be arranged alternately without overlapping with the actuator units 19 (illustrated on the passage unit 20 with alternate long and two short dashes lines in FIG. 12) on a surface of the passage unit 20. In the filter assembly 73 shown in FIG. 11, the filter supporting members 63 are disposed to neighbor each other at a distance shorter than a distance at which they are to be arranged on the surface of the passage unit 20 (see FIG. 12).

The filter supporting members 63, the interconnecting portions 73*d*, the frame portion 73*g*, and the peripheral connecting portions 73*e* are formed in one piece.

Figure 11:
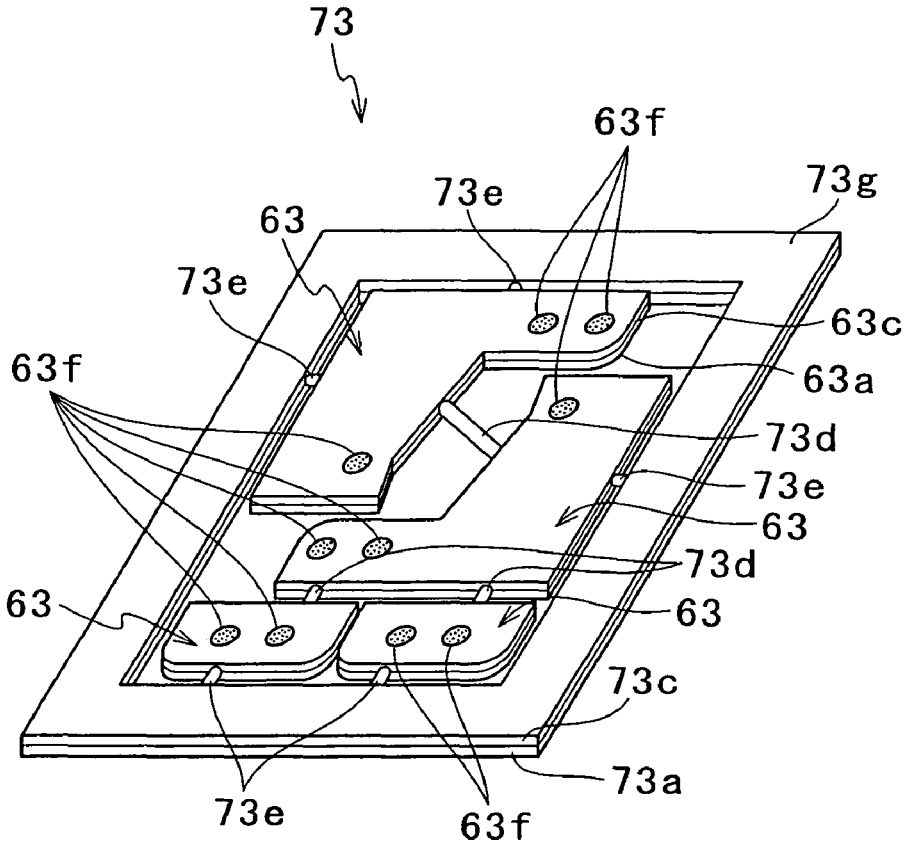
FIG. 11 is a perspective view of a filter assembly used for the ink-jet head illustrated in FIG. 9.
Figure 12:
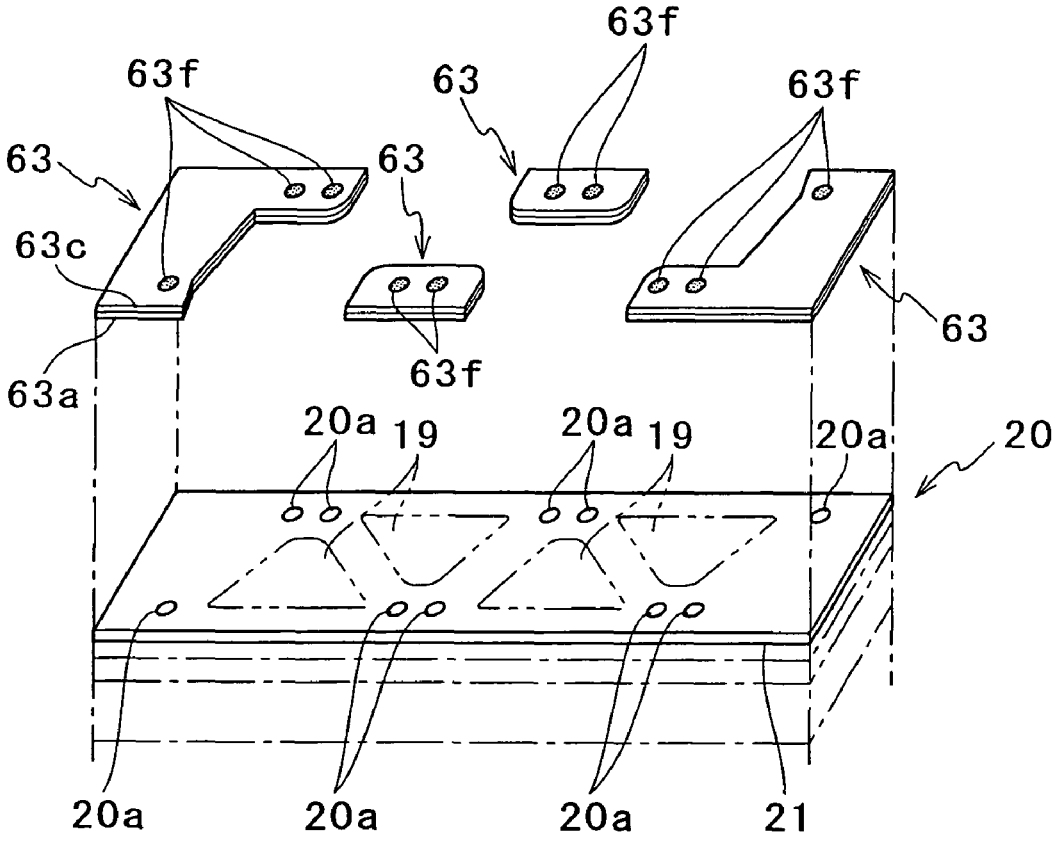
FIG. 12 is a perspective view illustrating a state where filter supporting members included in the filter assembly in FIG. 11 have been separated from each other and are now to be disposed on a surface of the passage unit.

The filter assembly 73 is, as shown in FIG. 11, formed by a metal plate 73*a* such as a plate of stainless steel and a resin plate 73*c* such as a plate of polyimide being laminated with each other. Each component of the filter assembly 73 is formed by etching the metal plate 73*a* to leave outlines of the filter supporting members 63 and the frame portion 73*g*, and subsequently applying laser machining to the resin plate 73*c* to leave outlines of the interconnecting portions 73*d* and the peripheral connecting portions 73*e* in addition to outlines of the filter supporting members 63 and the frame portion 73*g*.

Thus, the filter supporting member 63 has a layered structure laminated with a metal plate 63*a* and the resin plate 73*c*. Then, openings 63*b* as illustrated in FIG. 9 are formed by etching portions of the lower metal plate 63*a* corresponding to the filters 63*f*. Thereafter, the filters 63*f* are formed in the filter supporting members 63 by making, with excimer laser machining, a large number of small-diameter pores (16 to 24 micrometers) to neighbor each other concentratedly at portions of the upper resin plate 63*c* corresponding to the openings 63*b*.

The number of processing steps can be reduced by performing two etchings at the same time, i.e., the etching in the metal plate 73*a* of the filter assembly 73, and the etching for forming the openings 63*b* in the metal plate 63*a* of the filter supporting members 63.

The four filter supporting members 63 having the above construction are arranged on the surface of the passage unit 20 as illustrated in FIG. 12, and the second plate 62 and the first plate 61 are laminated on the filter supporting members 63, so that an ink branching passage for branching ink from the ink introduction port 61*a* to the ink outlet ports 62*b* and then to the filters 63*f* formed in the filter supporting members 63 is formed within the branching passage unit 60.

As described above, according to the filter assembly 73 of the present embodiment, the number of parts can be restrained, because the four filter supporting members 63 are manufactured as a single part. Accordingly, the filter assembly 73 is compact and easy to handle while comprising four filter supporting members 63.

Additionally, since the filter supporting members 63 are disposed to neighbor each other, processing time for forming the filters 63*f* can be shortened, particularly in case of applying excimer laser machining. This is because a relatively short distance between the filters 63*f* can shorten a traveling distance of a laser head in performing excimer laser machining. Such a shortening of the processing time can reduce manufacture costs.

Moreover, the filter supporting members 63 are disposed to neighbor each other at a distance shorter than a distance at which they are to be arranged on the surface of the passage unit 20, and the filters 63*f* are thereby disposed collectively. Therefore, a processing efficiency, particularly as described above, can be improved. When each filter supporting member 63 is arranged on the surface of the passage unit 20, on the other hand, the filter supporting members 63 may be arranged at a distance from each other so as to flexibly correspond to various layouts of the inlet ports 20*a*.

Further, a compact layout of the actuator units 19 and the filter supporting members 63 can be realized, because each filter supporting member 63 is formed in such a shape as to be arranged alternately without overlapping with the actuator units 19 on the surface of the passage unit 20, as shown in FIG. 12. This can realize a compactification of the head 202*a*.

Still further, the filter supporting members 63 can easily be separated from each other, because the filter supporting members 63 are connected with each other by means of the interconnecting portions 73*d* each having the elongated shape elongated in the direction of connecting the filter supporting members 63.

Still further, the filter assembly 73 comprises the frame portion 73*g* surrounding the peripheries of the four filter supporting members 63, and therefore, can be handled more easily. For example, a problem that the filter supporting members 63 may be damaged during transportation of the filter assembly 73 can be decreased.

Still further, since the filter supporting members 63, the interconnecting portions 73*d*, the frame portion 73*g*, and the peripheral connecting portions 73*e* are formed in one piece, manufacture costs can be reduced.

Next, a method for manufacturing the ink-jet head 202 using the filter assembly 73 according to the present embodiment will be described. Here will be described, however, a method for manufacturing only the head main body 202*a* in the head 202 illustrated in FIG. 9.

First, the passage unit 20 is formed by positioning and laminating the flat plates 20 to 29 (see FIG. 6), while manufacturing the filter assembly 73 illustrated in FIG. 11.

In a manufacturing process of the filter assembly 73, the filter supporting members 63, the interconnecting portions 73*d*, the frame portion 73*g*, and the peripheral connecting portions 73*e* are formed in one piece, as described above. In this process, additionally, the four filter supporting members 63 are disposed to neighbor each other at the distance shorter than the distance at which they are to be arranged on the surface of the passage unit 20 (see FIG. 12). Moreover, the filters 63*f* are formed by excimer laser machining, as described above.

The four filter supporting members 63 get separated from each other by bending the interconnecting portions 73 at the boundaries between the interconnecting portions 73 and the filter supporting members 63. The frame portion 73*g* and the filter supporting members 63 adjacent to the frame portion get separated from each other by bending the peripheral connecting portions 73*e* at the boundaries between the peripheral connecting portions 73*e* and the filter supporting members 63. In this separating process, a cutting may be performed, for example, by applying force to an appropriate interconnecting portion 73*d* or peripheral connecting portion 73*e* while holding the filter assembly 73 by hand.

Then, as shown in FIG. 12, each filter supporting member 63 is arranged on the surface of the passage unit 20 such that each filter 63*f* may face each inlet port 20*a*.

Subsequently, the actuator units 19 are alternately arranged on the surface of the passage unit 20 so as not to overlap with the filter supporting members 63 arranged in the above-described manner. A process of arranging the actuator units 19 may be either before or after a process of arranging the filter supporting members 63, and these two processes may also be coincident.

The first and second plates 61 and 62 bonded to each other and constituting the branching passage unit 60 are fixed to the passage unit 20 such that each filter supporting member 63 may contact with an appropriate position in the lower face of the second plate 62.

In the head main body 202*a* having the above construction, as illustrated in FIG. 5A for example, ink introduced from the ink supply source 200 is firstly introduced from the ink introduction port 61*a* into the ink reservoir 62*a*, where the ink is reserved for a time. Then, the ink in the ink reservoir 62*a* is led, through the notches 62*c*, from the ink outlet ports 62*b*, and further the ink passes through the filters 63*f* formed in the filter supporting members 63. At this time, foreign matters mixed in the ink is removed by the filters 63*f*. The ink having passed through the filters 63*f* is led, through the openings 63*b*, to the inlet ports 20*a* in the passage unit 20, and then introduced into the manifold channel 30. The ink flows from the manifold channel 30 to the ink ejection port 13 in the same manner as in the first embodiment. Thus, the description of the ink flow thereafter is omitted.

As described above, the same effects as those of the above-described filter assembly 73 can be obtained by the method for manufacturing the ink-jet head 202 using the filter assembly 73. Moreover, the ink-jet head 202 having the same effect as that of the ink-jet head 2 in the first embodiment, i.e., the effect that a variation of passage resistance in the individual ink passage is restrained to realize an improved printing quality, can be manufactured using the filter assembly 73.

In the aforementioned first, second, and third embodiments, the pores constituting the filters 43*f*, 53*f*, and 63*f* may be formed by various methods, not limited to the excimer laser machining.

The resin plates 43*c*, 53*c*, 63*c*, and 73*c* may be made of various resins such as polyester or vinyl chloride, etc., instead of polyimide. The metal plates 43*a*, 53*a*, 63*a*, 73*a*, the first plates 41, 51, 61, and the second plates 42, 52, 62 may be made of various metals, for example, nickel alloy such as 42ALLOY or INVAR, etc., instead of stainless steel.

The members formed with the filters 43*f*, 53*f*, and 63*f* are not limited to the layered structure laminated with the metal plate and the resin plate, and may be a plate made of a single material.

The number of ink introduction ports 41*a*, 51*a*, and 61*a* is not limited to one, and the number of the ink introduction ports formed may be optional. The shape of the ink introduction ports may also be variously changed.

The shape of the ink outlet ports 43*b*, 52*b*, 62*b* may also be variously changed, and may be, for example, square shape or elliptic shape. The filters 43*f* and 63*f* in the first and third embodiments are formed in the same shape as that of the ink outlet ports 43*b* and 62*b*.

The reservoir communication hole 53*b* in the second embodiment may formed in optional numbers, in optional shapes, and at optional positions, as long as the reservoir communication hole 53*b* is capable of introducing ink into the ink reservoir 52*a*. In this case, the number, shape and position of the filters 53*f* need to be conformed with those of the reservoir communication holes 53*b*.

In the first and second embodiments, the branching passage unit is not necessarily formed by laminating a plurality of plates, as long as a filter is formed in an ink branching passage within the branching passage unit.

In the third embodiment, the filter supporting member 63 may be designed so as to cover any optional inlet port 20*a*.

In the third embodiment, moreover, a press working may be performed for manufacturing the filter assembly 73 so as to leave the filter supporting members 63, the interconnecting portions 73*d*, the peripheral connecting portions 73*e*, and the frame portion 73*g*, all of which are components.

In the third embodiment, moreover, it is satisfactory to form the interconnecting portions 73*d* and the peripheral connecting portions 73*e* to have such a strength as to avoid damaging during transportation of the filter assembly 73. Accordingly, both of the interconnecting portions 73*d* and the peripheral connecting portions 73*e* may be formed in either of the resin plate 73*c* and the metal plate 73*a*, and their number and position, etc., are not particularly limited.

In the third embodiment, moreover, the filter supporting members 63, the interconnecting portions 73*d*, the frame portion 73*g*, and the peripheral connecting portions 73*e* may not be formed in one piece.

In the third embodiment, moreover, the number of the filter supporting members 63 included in the filter assembly 73 is not limited as long as no less than two filter supporting members 63 are included.

The present invention can be applied to, for example, a serial type of ink-jet printer, which performs a printing by transferring a paper as well as reciprocating the head main body 2*a* perpendicularly to the transferring direction of the paper, instead of the line type of the ink-jet printer as in the aforementioned embodiments, which performs a printing by transferring a paper with respect to the fixed head main body 2*a*.

Further, the application of the present invention is not limited to an ink-jet printer. The present invention is also applicable, for example, to an ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A filter assembly comprising:

a plurality of filter supporting members disposed to neighbor each other;

interconnecting portions that connect the neighboring filter supporting members with each other, each of the interconnecting portions being rod shaped such that the each of the interconnecting portions occupies only a part of a space between the neighboring filter supporting members, a bending strength on a boundary between the interconnecting portion and the filter supporting member being smaller than a bending strength of the filter supporting member; and a filter formed in each of the plurality of filter supporting members, the plurality of filter supporting members being configured so that when the filter supporting members are arranged on a passage unit in an ink-jet head, the filter formed therein covers inlet ports of the passage unit.

2. The filter assembly according to claim 1, wherein the plurality of filter supporting members are disposed to neighbor each other at a distance shorter than a distance at which they are to be arranged on a surface of the passage unit.

3. The filter assembly according to claim 1, wherein the filter is formed by excimer laser machining.

4. The filter assembly according to claim 1, wherein each of the filter supporting members includes a metal plate and a resin plate, and the plate in which the filter is formed is a resin plate.

5. The filter assembly according to claim 1, wherein the plurality of filter supporting members are formed to be arranged alternately on a surface of the passage unit so as not to overlap actuators for changing volumes of pressure chambers formed on the passage unit.

6. The filter assembly according to claim 1, wherein each of the interconnecting portions has an elongated shape in a direction where two of the filter supporting members connected by the interconnecting portion are disposed to neighbor each other.

7. The filter assembly according to claim 1, wherein the filter supporting members and the interconnecting portions are formed in one piece.

8. The filter assembly according to claim 1, further comprising:

a frame portion surrounding the plurality of filter supporting members; and peripheral connecting portions for connecting the frame portion with the filter supporting members adjacent to the frame portion, bending strength on a boundary between the peripheral connecting portion and the filter supporting member being smaller than bending strength of the filter supporting member.

9. The filter assembly according to claim 8, wherein the filter supporting members, the interconnecting portions, the frame portion, and the peripheral connecting portions are formed in one piece.

* * * * *